US008087133B2

(12) United States Patent
Jerger et al.

(10) Patent No.: US 8,087,133 B2
(45) Date of Patent: Jan. 3, 2012

(54) TRANSPORT CARRIAGE FOR NEEDLE BOARDS

(75) Inventors: Franz Jerger, Albstadt (DE); Bernhard Münster, Messstetten (DE); Thomas Maier, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 58 days.

(21) Appl. No.: 12/712,865

(22) Filed: Feb. 25, 2010

(65) Prior Publication Data

US 2010/0218352 A1 Sep. 2, 2010

(30) Foreign Application Priority Data

Feb. 27, 2009 (EP) ..... 09153989

(51) Int. Cl.
*D04H 18/00* (2006.01)

(52) U.S. Cl. ..... 28/107; 28/115

(58) Field of Classification Search ..... 28/107, 28/115, 108–114; 414/332, 426, 428, 429, 414/458, 331.06, 331.14; 280/47.17, 47.24, 280/47.34, 79.3
See application file for complete search history.

(56) References Cited

U.S. PATENT DOCUMENTS

| | | | | | |
|---|---|---|---|---|---|
| 3,486,650 | A | * | 12/1969 | Boone | 414/458 |
| 3,574,907 | A | * | 4/1971 | Agache et al. | 28/172.1 |
| 4,166,638 | A | * | 9/1979 | De Prado | 280/638 |
| 4,302,023 | A | * | 11/1981 | Kiesz | 280/43.24 |
| 4,512,473 | A | * | 4/1985 | Thomaswick et al. | 206/454 |
| 5,018,930 | A | * | 5/1991 | Hardin et al. | 414/458 |
| 5,033,933 | A | | 7/1991 | Sinclair et al. | |
| 5,287,604 | A | * | 2/1994 | Feyerl | 28/115 |
| 5,699,595 | A | * | 12/1997 | Feyerl | 28/107 |
| 5,823,737 | A | * | 10/1998 | Cook | 414/621 |
| 6,003,215 | A | * | 12/1999 | St. Jacques | 28/115 |
| 6,079,941 | A | * | 6/2000 | Lee | 414/812 |
| 6,145,176 | A | * | 11/2000 | Egnaczak et al. | 28/107 |
| 6,186,728 | B1 | * | 2/2001 | Michaud | 414/458 |
| 6,195,855 | B1 | * | 3/2001 | Feyerl | 28/115 |
| 6,230,752 | B1 | * | 5/2001 | Dornier et al. | 139/1 R |
| 2009/0064475 | A1 | * | 3/2009 | Munster et al. | 28/115 |

FOREIGN PATENT DOCUMENTS

| | | | |
|---|---|---|---|
| DE | 4415429 | | 11/1995 |
| DE | 202004006091 | | 7/2004 |
| JP | 2000-110061 | * | 4/2000 |
| WO | 2009003247 | | 1/2009 |

* cited by examiner

*Primary Examiner* — Amy Vanatta

(74) *Attorney, Agent, or Firm* — Fitch, Even, Tabin & Flannery; Norman N. Kunitz

(57) ABSTRACT

The transport carriage (1) for the accommodation of a needle board (2) comprises a console (21) that is preferably supported so as to be pivotable about a rotational axis (22). Clamping jaws (24, 25) are provided on the console (21), with the clamping jaws clamping the needle board (2)—preferably in a force-limited manner—between each other and thus holding said needle board in a frictionally engaged manner.

14 Claims, 5 Drawing Sheets

TRANSPORT CARRIAGE FOR NEEDLE BOARDS

CROSS-REFERENCE TO RELATED APPLICATION

The present application claims the priority of European Patent Application No. 09 153 989.0, filed Feb. 27, 2009, the subject matter of which, in its entirety, is incorporated herein by reference.

BACKGROUND OF THE INVENTION

The invention relates to a transport carriage for transporting and handling needle boards, such as are being used in felting machines.

Felting machines are being used for the manufacture of felt, said felting machines comprising needle boards. Such a needle board is a large plate-shaped component that is fitted with many felting needles that project away from a surface of the needle board. While one or more such needle boards are being used in a felting machine, the needle boards are mostly kept readily available in larger numbers at a storage location in order to be installed in and removed from the felting machine as needed.

Felting needles are subject to wear. Therefore, the felting needles on the needle boards need to be replaced on occasion. To accomplish this, automatic fitting machines are used, into which the needle boards need to be moved or out of which the needle boards need to be transported as needed. The needle boards may have a considerable weight of several kilograms, e.g., 50 kg and more, and may be very large. On the one hand, the felting needles are very sensitive. They must be damaged neither during transport nor during storage. Already minimal bending of one or more of the felting needles is unacceptable. On the other hand, the felting needles frequently have a very sharp point, a sharp edge and/or are provided with barbs, so that they pose a considerably injury hazard.

It is the object of the invention to provide a transport device for the gentle and hazard-free transport of the needle boards.

SUMMARY OF THE INVENTION

The above object generally is achieved with a transport carriage in accordance with the invention that comprises a base frame with running wheels, so that said carriage can be manually moved on the floor of a hall or, optionally, also by means of an attached or associated driving device. The running wheels are preferably free-running. One or more of them may also be associated with driving devices, braking devices and the like.

The base frame of the transport carriage carries an accommodation arrangement for a needle board. This accommodation arrangement comprises at least one console with at least one support surface for the needle board and with at least one clamping arrangement with which the needle board can be clamped to and held on the console.

The console is provided with at least one support surface for the needle board and with a clamping arrangement that is disposed to tension the needle board on the console and, in so doing, hold said needle board on the support surface.

The needle board (its reverse side) is placed on the support surface and pushed onto the support surface from one side. The clamping device is used to tension the needle board. The tension is preferably due to frictional engagement and displays a tension force such that the inherent weight of the needle board fitted with needles cannot—in any position— pull the needle board out of the clamping arrangement. In this manner, the needle board is temporarily connected to the console.

Considering a preferred embodiment, the entire accommodation arrangement, or at least the console, can be adjusted in one direction, preferably the vertical direction. As a result of this, the console can be adapted to various heights, e.g., in order to be moved between shelves of different heights where the needle boards can be stored, a machine in which the needle board is to operate, and an automatic fitting machine where the needles can be removed from the needle board and, optionally, new needles can be applied.

Furthermore, it is advantageous if the console, additionally or alternatively, can carry out a pivoting movement about at least one axis. This axis is oriented, for example and preferably, parallel to the support surface. In addition this axis extends away from a vertical column on which the accommodation arrangement is supported so as to be preferably height-adjustable. In so doing, the console and, with it, the needle board clamped thereto can be swiveled into a vertical position, thus facilitating the transport of the needle board.

Preferably, the clamping arrangement comprises two oppositely arranged clamping jaws. Preferably, the clamping jaws have flat clamping surfaces and are disposed to hold the needle board at opposing long narrow sides, for example, in that they clamp the needle board between them. To accomplish this, at least one of the two clamping jaws is supported so as to be adjustable, in which case the adjustment is accomplished by means of an actuation arrangement. In so doing, the direction of adjustment is preferably parallel to the support surface of the console. In so doing, the needle board is not pushed against the support surface but held between the clamping jaws. However, it is also possible to provide clamping jaws that tension the needle board toward the support surface.

Preferably, the two clamping jaws comprise pressure surfaces between which the needle board is tensioned, said pressure surfaces being arranged parallel to each other and being provided with a profile or being plane. In so doing, it is advantageous if at least one of the two clamping jaws is supported in a floating manner. Preferably, the clamping jaw that is supported in a floating manner may perform at least a minimal pivoting motion about an axis that is perpendicular to the support surface. In this manner, the clamping jaw may adapt to the needle boards when their narrow sides are not aligned in an ideally parallel manner or do not have an exactly straight form. To do so, it may be advantageous if the respective clamping jaw is supported in a resilient manner, for example. To accomplish this, for example, a relatively hard, preferably pretensioned, spring with minimal spring displacement, for example, only a few millimeters, is chosen. If, for example, the clamping jaw is held by way of two such springs on an adjustment device belonging to the actuation arrangement or on a clamping jaw support, the one or more springs are tensioned when the adjustment device is tightened and firmly push the clamping jaws against the nail board. The advantage of this embodiment is that it is insensitive to vibrations. If the needle board is tensioned, it remains firmly held between the clamping jaws.

The resiliently supported clamping jaw is preferably connected to an indicator device that may indicate, for example, the tension of the aforementioned hard spring in order to signal to the operator whether or not the needle board is mounted in a sufficiently tight manner. The spring is defined as a "hard" spring when the maximum spring force that the spring must achieve (before it is fully compressed) is greater than the maximum clamping force for mounting the needle board. When several springs are provided, this applies, accordingly, to the corresponding fraction of the clamping force. In the simplest case, the indicator arrangement is a mechanism for indicating the compression of said spring.

Preferably, the adjustment device is located underneath the support surfaces. Consequently, it does not in any way interfere with the seating of the needle board on the support.

The clamping jaw is connected to the adjustment device, preferably via a disengageable coupling arrangement. Consequently, the console or the adjustment device may, optionally, be provided with different clamping jaws, for example, to provide an adaptation to different needle boards.

In addition, it is advantageous if the coupling arrangement defines various coupling positions. As a result of this, needle boards having different widths may be accepted by the transport carriage and clamped to the console. In so doing, the range of the different board widths may be greater than the range of adjustment of the adjustment device.

It is advantageous if a clamping force limiting means is provided in order to limit the clamping force of the clamping arrangement. This clamping force limiting means may be a torque-limiting arrangement by way of which the adjustment device is manually operated, for example. The clamping force limiting means may be designed in the manner of a torque wrench. It may be a separate element or a component of the accommodation arrangement. For example, the clamping force limiting means may also be a manual crank with a resiliently supported handle, whereby the crank hand is slightly yielding in a resilient manner when the adjustment device is tightened, this being indicated on a scale as the adjustment force.

Additional details of advantageous embodiments result from the claims, the drawings or the description. The description is restricted to essential aspects of the invention and miscellaneous situations. The drawings disclose additional details and supplement the description.

DETAILED DESCRIPTION OF THE INVENTION

Figure 1:
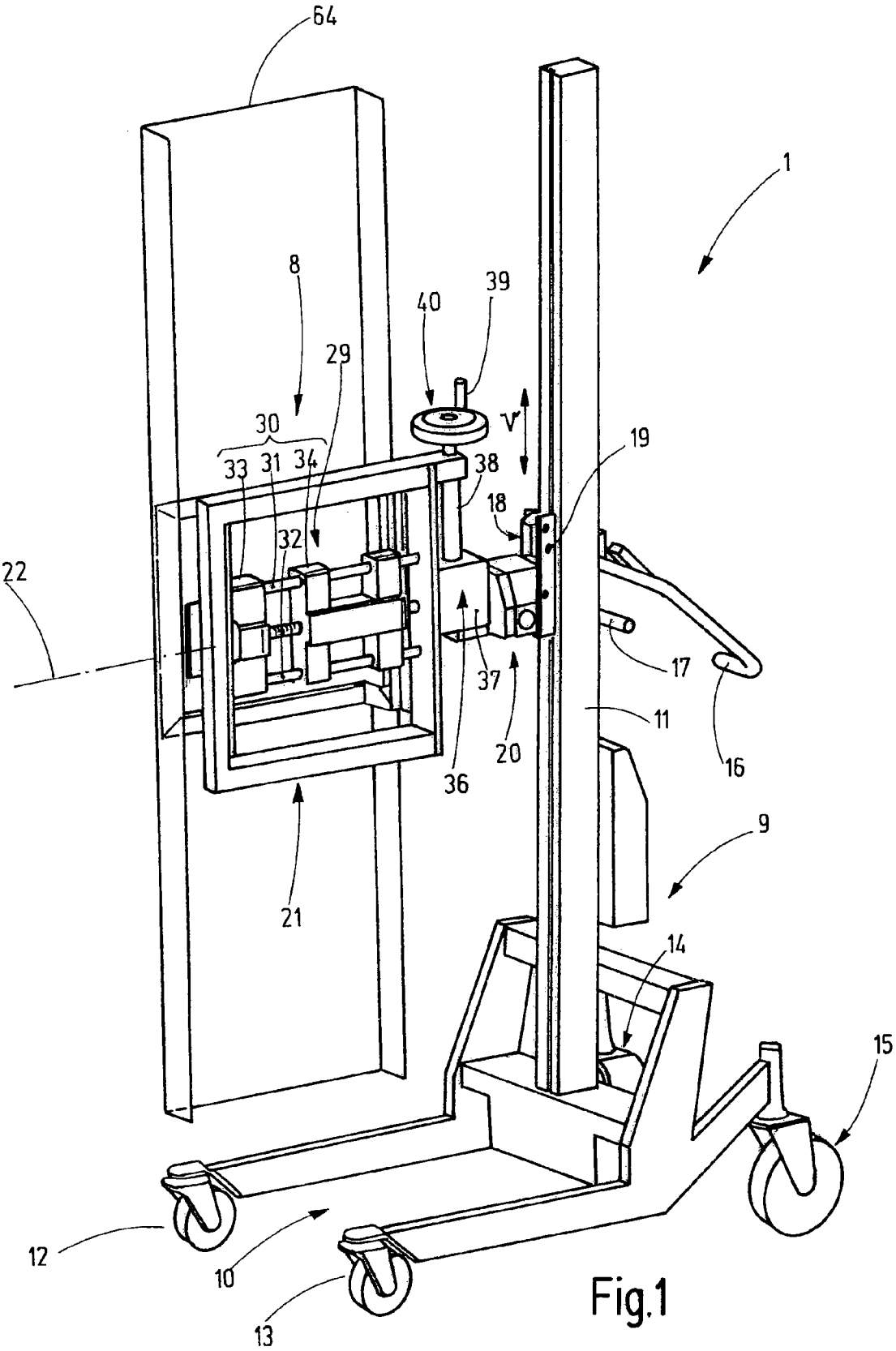
FIG. 1 is a perspective general view of the inventive transport carriage with the needle board, with the accommodation arrangement in a vertical position.
Figure 3:
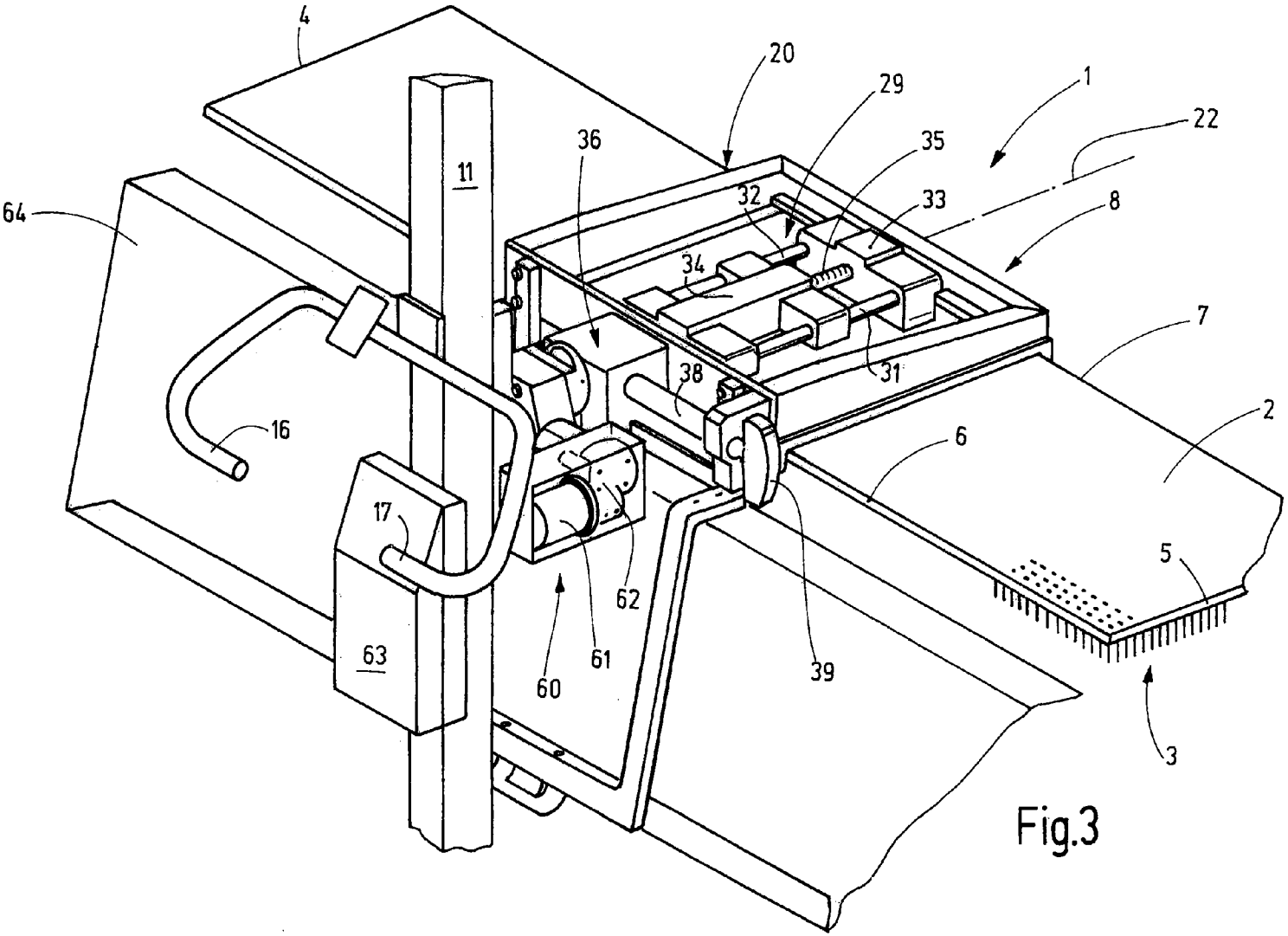
FIG. 3 is a perspective representation of a detail of the transport carriage in accordance with FIG. 1, in holding position with the needle board, whereby the needles face downward.

FIG. 1 shows a transport carriage 1 that, in accordance with FIG. 3, is disposed for accommodating and transporting a needle board 2. The needle board 2 is a plate-shaped element with a plurality of felting needles 3 that essentially extend at a right angle from one flat side of the needle board 2 and that are held on the needle board 2. The needle board 2 has, e.g., a rectangular contour with two short narrow sides 4, 5 and two long narrow sides 6, 7. Said needle board is held in an accommodation arrangement 8 that, in turn, is held by a base frame 9 of the transport carriage 1.

The transport carriage 1 has a foot 10 from which extends a column 11 upward in vertical direction. The foot 10 has struts with rollers 12, 13, 14, 15, or also adjustment feet. One or more handles 16, 17, as are obvious from FIG. 3, are used for moving the transport carriage 1.

The accommodation arrangement 8 is arranged at a fixed height or, as is preferred, arranged so as to be vertically adjustable (arrow V, FIG. 1) on column 11. The associate adjustment arrangement 18 may be actuated either by hand or by motor. This arrangement includes a slide 19 that can be guided in vertical direction on column 11. The adjustment drive may be an electric motor or also a hydraulic drive, or also an arrangement that can be manually actuated. The latter may comprise a weight-compensating device, for example, in the form of a pneumatic spring that pretensions the slide 19 toward the top and is able to compensate for the weight of a needle board and the accommodation arrangement 8. It is also possible to use the handle 16, 17 for a height adjustment of the accommodation arrangement 8. For example, the handle 16, 17 may be pivotally supported so as to perform an incremental or stepped lifting or lowering movement of the accommodation arrangement 8. Considering the vertical adjustment of the accommodation arrangement 8, numerous design modifications are possible.

Figure 2:
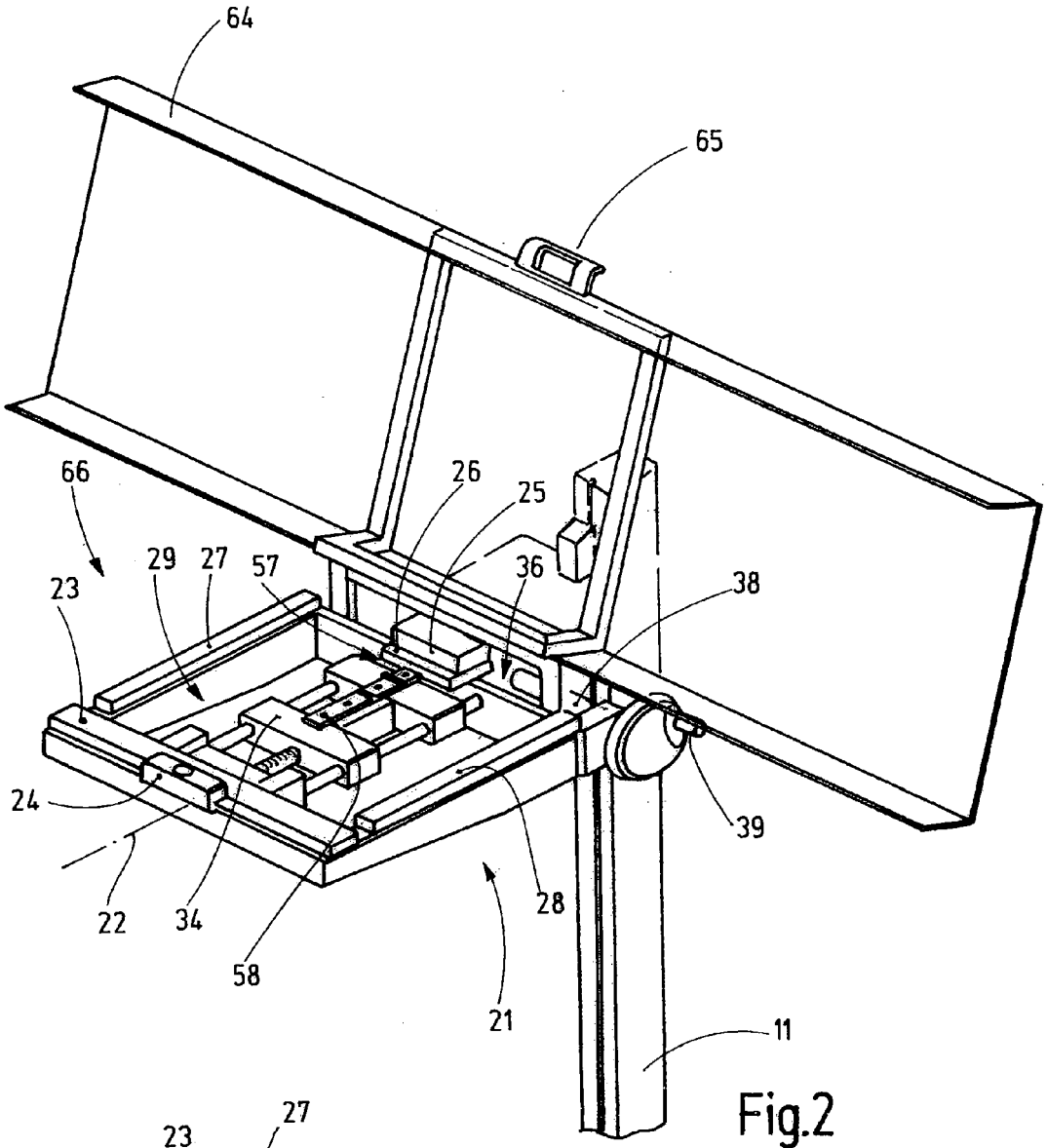
FIG. 2 is a perspective representation of a detail of the transport carriage in accordance with FIG. 1, with the accommodation arrangement in a horizontal position.

The accommodation arrangement 8 comprises a pivoting arrangement 20 that is supported on the column 11, for example, via the slide 19. Furthermore, the accommodation arrangement comprises a console 21 that is supported by the pivoting arrangement 20. The console 21 is disposed to accommodate the needle board 2. As is obvious from FIGS. 1 through 3, it is represented by a square or even rectangular frame, viewed in plan view. Preferably, the console 21 is supported on the pivoting arrangement 20 so as to be pivotable about a horizontal axis 22 that extends above the rollers 12, 13 transversely away from the column 11. FIGS. 1 through 3 show the console 21 in different pivoting positions about the axis 22.

Basically, it is possible to provide the pivoting arrangement 20 with additional adjustment options that are missing in the case of transport carriage 1 in accordance with the present embodiment. For example, if necessary, the pivoting arrangement 20 can be modified in such a manner that the console 21 may be pivoted about an additional axis, said axis being aligned, for example, parallel to a long narrow side 6 or 7 of the needle board 2 and thus transversely with respect to the axis 22.

The accommodation arrangement 21 has at least one support surface 23 on its upper side, said support surface being preferably oriented in a direction transverse to the axis 22. The length of the support surface 23 may be different from the length of the long narrow side 7 of the needle board and may be substantially shorter. The needle board 2 abuts, in the proximity of its narrow side 7, against the support surface. Furthermore, the accommodation arrangement 21 comprises a clamping arrangement 66 that comprises the two clamping jaws 24, and the adjustment device 29. Considering the embodiment in accordance with FIG. 2, a clamping jaw 24 is arranged in the immediate vicinity of the support surface 23, said clamping jaw being mounted to the console 21 in a prespecified position. On the side opposite thereto, another clamping jaw 25 is provided, said clamping jaw being supported so as to be movable back and forth relative to the clamping jaw 24. The clamping jaws 24 and 25 may be arranged in such a manner that they can be uniformly moved toward each other and away from each other, thus facilitating the tensioning and the releasing of the needle board 2. Below the clamping jaw 25, there may be a surface 26 that is on one plane with the support surface 23 and may thus also be used as a support surface. Considering the present embodiment, the needle board 2 is situated on the surface 26 and the support surface 23. The console 21 is provided—on its upper side—with two strip-shaped support elements that have—on their upper side—support surfaces 27, 28. With the support surface 23 and the surface 26, they may be on a common plane and can be arranged parallel to the axis 22. It is also possible for the support surfaces 27, 28 to be located below a plane that is formed by the support surface 23 and the surface 26. Then, they act as a support of a needle board 2 when said needle board leaves the support surface 23 and the surface 26 while said needle board is being released from the adjustment device 29, for example. The strip-shaped elements having support surfaces 23, 27, 28 may be plastic elements, rubber elements or the like.

Figure 2A:
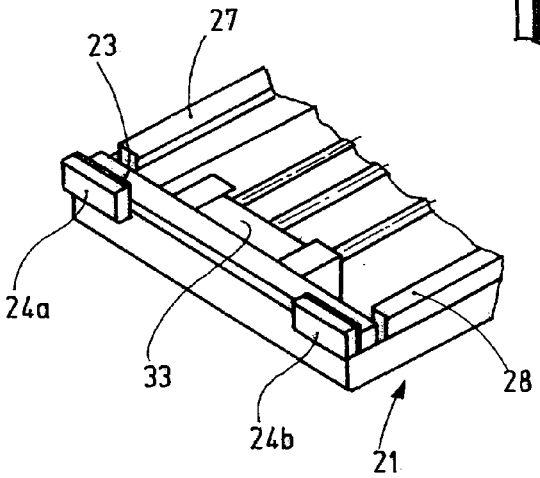
FIG. 2*a* is a perspective representation of a detail of the accommodation arrangement in accordance with FIG. 2.

In order to ensure tensioning of a needle board, the clamping jaw 24 may consist of two clamping means 24*a* and 24*b*. These two clamping means are arranged at a distance from each other on the console 21 (FIG. 2*a*). As a result of this, it is possible that a needle board 2 that has initially been placed in the adjustment device 29 inclined with respect to the axis 22 is aligned by closing the clamping means 24*a* and 24*b* and the clamping jaw 25 and can be held securely.

For tensioning the needle board and for adjusting at least one of the clamping jaws 24, 25, the console 21 supports an adjustment device 29, as is obvious from FIGS. 1 through 3. The adjustment device 29 comprises a linear guide 30 that, in the present case, is represented by two rods 31, 32 that are parallel to each other, as well as one or more slides 33, 34 moving on said rods (see FIG. 1). The rods 31, 32 are, for example, round rods arranged parallel with respect to each other, said round rods being potentially aligned parallel to the axis 22 and their ends being held on the console 21. The two slides 33, 34 can thus be slid in longitudinal direction along the rods 31, 32.

A suitable drive, for example configured as a threaded spindle 35, can be used to move the slide 33, 34. Said spindle may be configured so as to adjust at least one of the two slides 33, 34, preferably however, both slides. To do so, the threaded spindle 35 has, for example, a right-handed thread in one section that is in connection with one of the slides, and a left-handed thread in another section that is in connection with the other of the two slides. Alternatively, it is possible to support the threaded spindle 35 on one of the two slides 33, 34 so as to be rotatable but not movable in axial direction, while the threaded spindle is in engagement with the a thread on the other of the two slides. This is another way to effect a relative movement of the two slides 33, 34 along the two rods 32, 31 toward each other and away from each other by turning the threaded spindle 35.

A driving arrangement 36 is provided in order to be able to rotate the threaded spindle 35 in a targeted manner and to thus be able to adjust at least one of the clamping jaws 24, 25 in a targeted manner. As is particularly obvious from FIGS. 1 and 3, said driving arrangement comprises, for example, an angle transmission 37 with an actuation spindle 38 and an end-side handle 39. The latter may be a simple adjustment as in FIG. 3 or be configured as a crank as in FIG. 1. In both cases, the angle transmission comprises, in or on the actuation spindle 38 or in or on the handle 39, a torque-limiting arrangement 40 that is configured, for example, in the manner of a torque wrench. Preferably, this torque-limiting arrangement 40 can be used to limit the torque for tensioning the needle board 2. In addition, it is possible—after the required torque has been reached—that an appropriate device generates a noise to indicate that this state. This device may be a slipping clutch with smooth or toothed clutch disks.

The clamping jaw 24 may be connected with the console 21 as in FIG. 2. Alternatively, said clamping jaw may be connected with the slide 33. The clamping jaw 25 is preferably connected with the slide 34.

Figure 4:
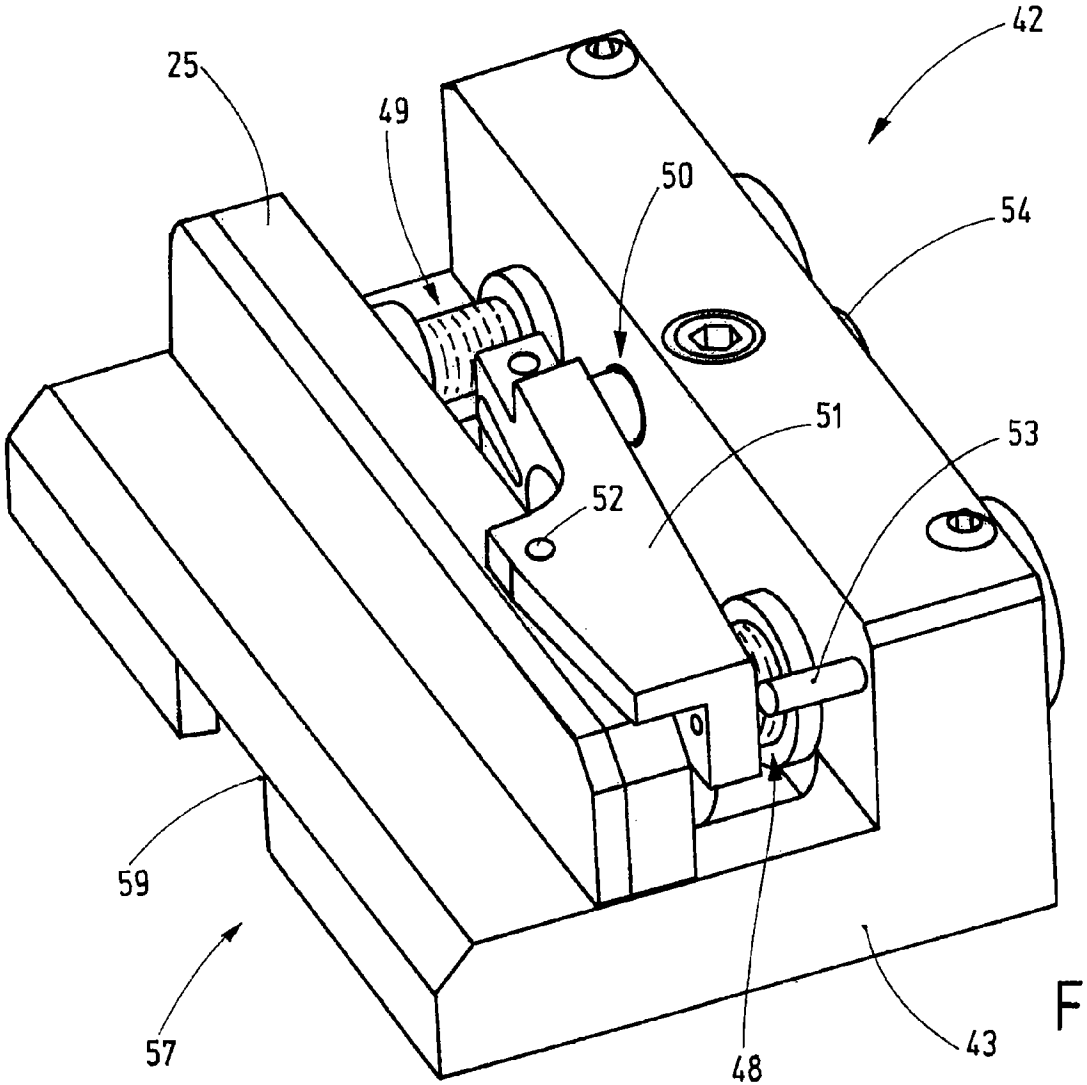
FIG. 4 is a perspective representation of a clamping jaw block of the accommodation arrangement.
Figure 5:
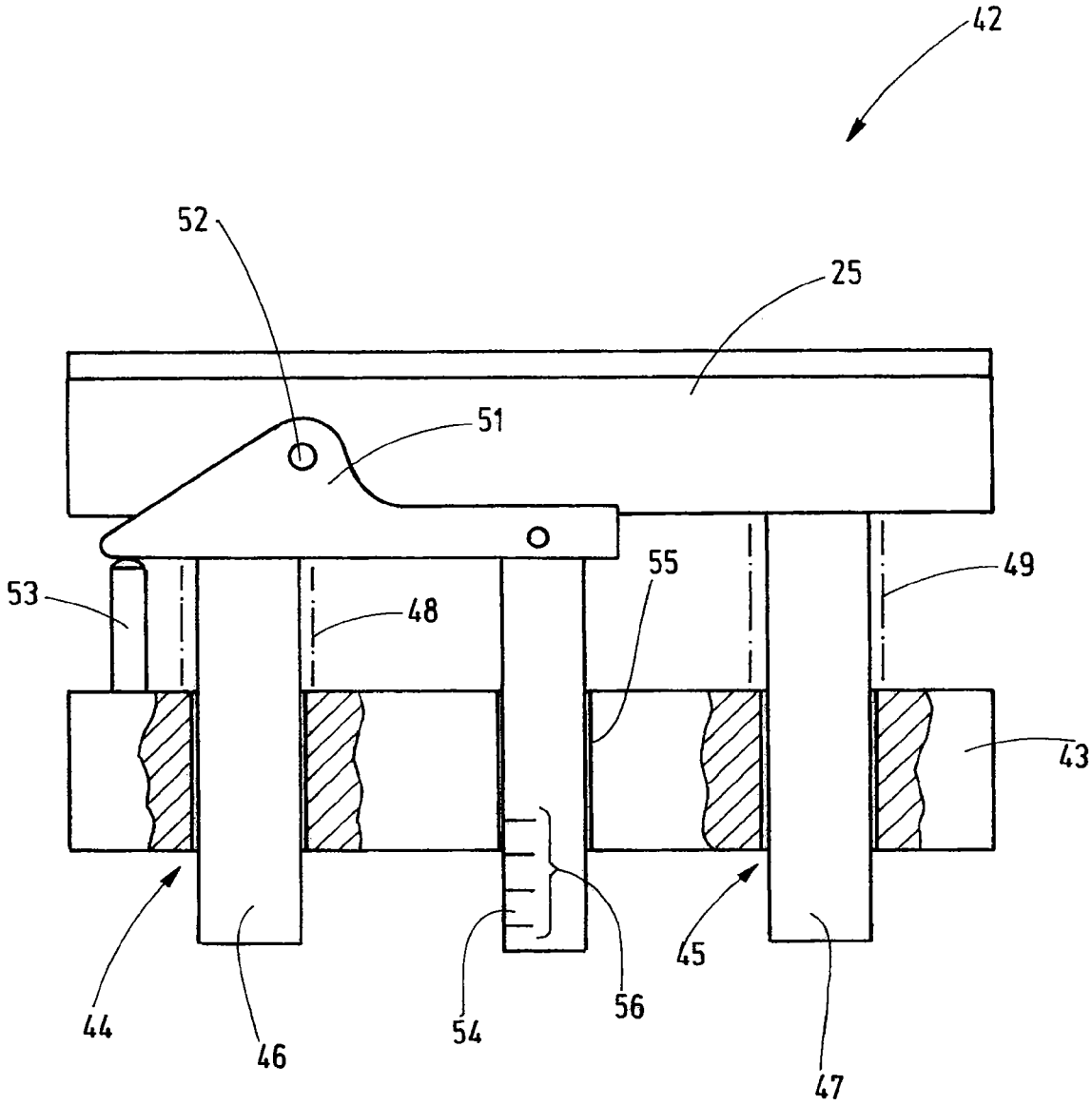
FIG. 5 is a separate plan view, partially in section, of the clamping jaw block in accordance with FIG. 4.

At least the clamping jaws 25 that is connected with the slide 33 and/or the slide 34 is part of a clamping jaw block 42 that is shown by itself in FIGS. 4 and 5. The clamping jaw block 42 comprises a clamping jaw carrier 43 on which the clamping jaws 25 is supported in a slightly floating manner. This is obvious from FIG. 5 that schematically shows the clamping jaw block 42. For example, the clamping jaw carrier 43 has two openings 44, 45, through which extend dogs 46, 47 that extend parallel to each other and are firmly connected to the clamping jaw 25 with transverse play. In so doing, the clamping jaw 25 abuts against the clamping jaw carrier 43 via the pressure springs preferably configured as disk spring packs 48, 49, these being indicated only schematically in FIG. 5. The disk spring packs 48, 49 form pretensioned hard springs with short displacement and relatively small spring travel. The spring force provided by the disk spring packs is as great as the required spring force, at least at one point of its spring travel.

Preferably, the clamping jaw block 42 comprises an additional tension indicator 50. The latter comprises, for example, a two-armed lever 51 in the manner of a rocker that, for example, is pivotally supported about a pin 52 on the clamping jaw 25. While a first end of the lever 51 may come into abutment with a stationary support pin 53 provided on the clamping jaw block 43, its other end is connected in an articulated manner with an indicator pin 54 that extends through an opening 55 of the clamping jaw carrier 43. The pin 54 may be provided with a scale, for example in the form of colored rings. Thus, the operator can easily detect how far the indicator pin 54 projects from the opening 55. This information may be used to determine if the needle board 2 is or is not tensioned in a sufficiently tight manner.

The clamping jaw block 42 is connected with the slide 34 by means of a disengageable coupling means 57. The coupling means 57 can be seen in FIG. 4 in conjunction with FIG. 2. Said coupling means comprises a detent strip 58 that is associated with a groove-like recess 59 provided on the underside of the clamping jaw carrier 43. Not specifically illustrated, preferably positive-locking connecting means are disposed to hold the clamping jaw block 42 on the slide 34 in a desired detent position. Preferably, the coupling means 57 defines several different detent positions so that the clamping jaw block 42 can be mounted to the slide 34 in different longitudinal positions. The coupling means 57 may have a length that reaches from the slide 33 to the slide 34 (not illustrated) and has more detent positions than shown in FIG. 2.

An actuation arrangement 60 allows the console 21 to be pivoted about the axis 22. This is schematically indicated in FIG. 3. It may comprise an electric motor 62 and an angle transmission 62. A control arrangement 63 may be disposed to allow the motor 61 to rotate forward or backward in a specific manner in order to rotate the console 21 with the needle board 2 forward or backward about the axis 22.

Furthermore, a hood 64 may be provided on the console 21, as is indicated by FIGS. 1 through 3. Said hood acts, in particular, as a protective cover for the needle board 2 and its needles 3. To accomplish this, the hood 64 preferably has a length that corresponds to the length of the needle board 2.

With the use of a short needle board 2, the hood 64 may also be considerably longer than the length of the needle board 2. In addition, said hood is supported on the console 21 so as to be preferably pivotable about an axis extending parallel to the longitudinal edge 6 or 7 of the needle board 2. Therefore, said hood can be pivoted away from the console (FIGS. 2 and 3) or toward the console (FIG. 1). A corresponding handle 65 is used for actuation. The pivotable support of the hood 64 may be configured as a detent bearing or as a torque-type hinge, so that the hood 64 can be positioned in different pivoting positions above the needle board 2.

The transport carriage 1 described so far operates as follows:

For the accommodation of a needle board 2, the console 21 is preferably brought into the position shown by FIG. 2. The desired height is adjusted. Then a needle board can be positioned on the support surfaces 23, 26 between the clamping jaws 24, 25. By rotating the handle 39, the clamping jaws 24, 25 are moved toward each other until they abut against the long narrow sides 6, 7 of the needle board 2. Now, the handle 39 is tightened so that the desired starting torque is reached. This is indicated, for example, by an indicator on the handle 39 or also on the clamping jaw block 42.

With increasing tension, the clamping jaw 25 is pushed increasingly tighter against the needle board 2. As soon as the force is sufficient to overcome the pretensioning force of the disk spring packs 48, 49 (FIGS. 4 and 5), the clamping jaw 25 moves slightly against the clamping jaw carrier 43. As a result of this, the lever 51 is deflected, and the indicator pin 54 moves more and more out of the opening 55. Once the desired value that can be read on the scale 56 is reached, the needle board 2 is firmly tensioned. Now, said needle board can be moved into the vertical position in accordance with FIG. 1 and moved to another location—e.g., a storage location—and, if desired, also be set down and picked up again on its short lateral edge 4 or 5.

At the acceptance location, the needle board 2 may also be brought into a horizontal position in which it is suspended with the needles 3 downward under the console 21. By releasing the clamping jaws 24, 25, said needle board is released and can thus be deposited on a respective accommodating location, e.g., a felting machine or an automatic fitting machine.

The transport carriage 1 in accordance with the invention comprises, for the accommodation of a needle board 2, a console 21 that is preferably supported so as to be pivotable about a rotational axis 22. Clamping jaws 24, 25 are provided on the console 21, said clamping jaws clamping the needle board 2—preferably in a force-limited manner—between each other and thus holding said needle board in a frictionally engaged manner.

It will be appreciated that the above description of the present invention is susceptible to various modifications, changes and modifications, and the same are intended to be comprehended within the meaning and range of equivalents of the appended claims.

LIST OF REFERENCE NUMERALS

1 Transport carriage
2 Needle board
3 Felting needles
4, 5 short narrow sides of the needle board
6, 7 long narrow sides of the needle board
8 Accommodation arrangement
9 Base frame
10 Foot
11 Column
12, 13, 14, 15 Rollers, running wheels
16, 17 Handle
18 Adjustment arrangement
19 Carriage
20 Pivoting arrangement
21 Console
22 Axis
23 Support surface
24, 25 Clamping jaw
26 Surface
27, 28 Support surfaces
29 Adjustment device
30 Linear guide
31, 32 Rods
33, 34 Slide
35 Threaded spindle
36 Driving arrangement
37 Angle transmission
38 Actuation spindle
39 Handle
40 Torque-limiting arrangement
41 elongated hole
42 Clamping jaw block
43 Clamping jaw carrier
44, 45 Openings
46, 47 Dogs
48, 49 Disk spring packs
50 Tension indicator
51 Lever
52 Pin
53 Abutment pin
54 Indicator pin
55 Opening
56 Scale
57 Coupling means
58 Detent strip
59 Recess
60 Actuation arrangement
61 Electric motor
62 Angle transmission
63 Control device
64 Hood
65 Handle
66 Clamping Arrangement

The invention claimed is:

1. Transport carriage for a needle board, comprising
a base frame with running wheels,
an accommodation arrangement for the needle board, said accommodation arrangement comprising:
at least one console with at least one support surface for the needle board, and
at least one clamping arrangement for clamping the needle board in place on the console; and,
wherein the accommodation arrangement comprises two opposing clamping jaws, at least one of which being supported so as to be movable toward and away from the oppositely located clamping jaw in order to clamp the needle board in place between them on oppositely arranged long narrow sides.

2. Transport carriage in accordance with claim 1, wherein the accommodation arrangement is supported on the base frame so as to be adjustable in at least one direction.

3. Transport carriage in accordance with claim 1, wherein the console is supported so as to be pivotable about at least one axis relative to the base frame.

4. Transport carriage in accordance with claim 3, wherein the console is associated with an actuation arrangement that, by an actuation movement, effects a pivoting movement of the console at least about the axis.

5. Transport carriage in accordance with claim 1, wherein the clamping jaws have pressure surfaces that are essentially parallel with respect to each other.

6. Transport carriage in accordance with claim 1, wherein at least one of the clamping jaws is resiliently supported.

7. Transport carriage in accordance with claim 1, wherein at least one of the clamping jaws is supported in a floating manner.

8. Transport carriage in accordance with claim 1, wherein at least one of the clamping jaws is firmly held on the console.

9. Transport carriage in accordance with claim 1, wherein at least one of the clamping jaws is carried by an adjustment device.

10. Transport carriage in accordance with claim 9, wherein the adjustment device comprises at least one slide supported on a linear guide said slide being movable by the linear guide toward and away from one of the clamping jaws.

11. Transport carriage in accordance with claim 10, wherein the adjustment device is arranged underneath the support surface on the console.

12. Transport carriage in accordance with claim 9, wherein the clamping jaw is disengageably connected with the adjustment device via a coupling arrangement.

13. Transport carriage in accordance with claim 12, wherein the coupling arrangement defines various coupling positions.

14. Transport carriage in accordance with claim 11, wherein a clamping force limiting means is provided for limiting the clamping force of the clamping arrangement.

* * * * *